US010015589B1

(12) United States Patent
Ebenezer

(10) Patent No.: US 10,015,589 B1
(45) Date of Patent: Jul. 3, 2018

(54) CONTROLLING SPEECH ENHANCEMENT ALGORITHMS USING NEAR-FIELD SPATIAL STATISTICS

(75) Inventor: Samuel Ponvarma Ebenezer, Tempe, AZ (US)

(73) Assignee: Cirrus Logic, Inc., Austin, TX (US)

( * ) Notice: Subject to any disclaimer, the term of this patent is extended or adjusted under 35 U.S.C. 154(b) by 1031 days.

(21) Appl. No.: 13/199,593

(22) Filed: Sep. 2, 2011

(51) Int. Cl.
*H04R 3/00* (2006.01)
*H04R 1/40* (2006.01)

(52) U.S. Cl.
CPC ..... *H04R 3/005* (2013.01); *H04R 1/406* (2013.01); *H04R 2201/401* (2013.01); *H04R 2201/403* (2013.01); *H04R 2410/05* (2013.01); *H04R 2430/21* (2013.01); *H04R 2430/23* (2013.01)

(58) Field of Classification Search
CPC ..... H04R 3/005; H04R 1/406; H04R 25/407; H04R 2201/401; H04R 2201/403; H04R 2410/05; H04R 2430/21; H04R 2430/23
USPC ..... 381/92, 98, 102–104, 107, 57, 313, 317, 381/318
See application file for complete search history.

(56) References Cited

U.S. PATENT DOCUMENTS

| | | | | |
|---|---|---|---|---|
| 5,493,540 | A | 2/1996 | Straus et al. | 367/135 |
| 6,243,322 | B1 | 6/2001 | Zakarauskas | |
| 6,243,540 | B1 | 6/2001 | Zakarauskas | 367/127 |
| 6,469,732 | B1 * | 10/2002 | Chang | G10L 25/78 348/14.01 |
| 6,549,630 | B1 | 4/2003 | Bobisuthi | 381/94.7 |
| 6,826,284 | B1 * | 11/2004 | Benesty et al. | 381/92 |
| 7,512,245 | B2 | 3/2009 | Rasmussen et al. | 381/110 |
| 7,746,225 | B1 | 6/2010 | Arnoult, Jr. et al. | 340/539.13 |
| 2003/0027600 | A1 | 2/2003 | Krasny et al. | 455/564 |
| 2004/0128127 | A1 * | 7/2004 | Kemp | G10L 17/26 704/225 |
| 2008/0152167 | A1 | 6/2008 | Taenzer | 381/94.2 |
| 2008/0175408 | A1 | 7/2008 | Mukund et al. | 381/94.7 |
| 2008/0189107 | A1 | 8/2008 | Laugesen | 704/233 |
| 2009/0073040 | A1 * | 3/2009 | Sugiyama | 342/378 |
| 2009/0129609 | A1 * | 5/2009 | Oh et al. | 381/92 |

(Continued)

OTHER PUBLICATIONS

"The Generalized Correlation Method for Estimation of Time Delay", by Charles H. Knapp and G. Clifford Carter, IEEE Transactions on Acoustics, Speech, and Signal Processing, vol. ASSP-24, No. 4, Aug. 1976, pp. 320-327.

*Primary Examiner* — Davetta W Goins
*Assistant Examiner* — Daniel Sellers
(74) *Attorney, Agent, or Firm* — Cahill Glazer PLC

(57) ABSTRACT

A telephone includes at least two microphones and a circuit for processing audio signals coupled to the microphones. The circuit processes the signals, in part, by providing at least one statistic representing maximum normalized cross-correlation of the signals from the microphones, doaEst, dirGain, or diffGain and comparing the at least one statistic with a threshold for that statistic. At least one of noise reduction and speech enhancement is controlled by an indication of near-field sounds in accordance with the comparison. Indication of near-field speech can be further enhanced by combining statistics, including a statistic representing inter-microphone level difference, each of which have their own threshold. dirGain and diffGain are derived from signals incident upon the microphones such that the desired near-field signal is not suppressed.

10 Claims, 8 Drawing Sheets

(56) References Cited

U.S. PATENT DOCUMENTS

2011/0038489 A1* 2/2011 Visser et al. ..... 381/92
2011/0305345 A1* 12/2011 Bouchard et al. ..... 381/23.1

* cited by examiner

CONTROLLING SPEECH ENHANCEMENT ALGORITHMS USING NEAR-FIELD SPATIAL STATISTICS

FIELD OF THE INVENTION

This invention relates to audio signal processing and, in particular, to a near field detector for improving speech enhancement or noise reduction.

GLOSSARY

As used herein, "telephone" is a generic term for a communication device that utilizes, directly or indirectly, a dial tone from a licensed service provider.

As used herein, "noise" refers to any unwanted sound, whether or not the unwanted sound is periodic, purely random, or somewhere in between. As such, noise includes background music, voices of people other than the desired speaker (referred to as "babble"), tire noise, wind noise, and so on. Moreover, the noise will often be loud relative to the desired speech. "Noise" does not include echo of the user's voice.

As used herein, "diffuse-field" refers to reverberant sounds or to a plurality of interfering sounds, which can come from several directions, depending upon surroundings.

A handset for a telephone is a handle with a microphone at one end and a speaker at the other end. Over time, handsets have evolved into complete telephones; e.g. cordless telephones and cellular telephones. Headsets, including Bluetooth® headsets, are functionally equivalent to a handset. "Handset" is intended as generic to such devices.

Because a signal can be analog or digital, a block diagram can be interpreted as hardware, software, e.g. a flow chart, or a mixture of hardware and software. Programming a microprocessor is well within the ability of those of ordinary skill in the art, either individually or in groups.

Those of skill in the art recognize that, once an analog signal is converted to digital form, all subsequent operations can take place in one or more suitably programmed microprocessors. Use of the word "signal", for example, does not necessarily mean either an analog signal or a digital signal. Data in memory, even a single bit, can be a signal. A signal stored in memory is accessible by the entire system, not just the function or block with which it is most closely associated.

BACKGROUND OF THE INVENTION

Ideally, a handset is held with the microphone near the user's mouth and the speaker near the user's ear. Often, particularly with cellular telephones, the positioning of the microphone is far from ideal, allowing the microphone to pick up extraneous and interfering sounds.

In many speech enhancement or noise reduction algorithms, it is often necessary to detect desired speech in the presence of interfering sounds. Conventional voice activity detectors are not capable of distinguishing desired speech from interfering signals that resemble speech. Techniques that use spatial statistics can detect desired speech in the presence of various types of interfering sounds. Spatial statistics require more than one microphone to achieve the best performance. For example, a second microphone is located at the end of the handset with the speaker but pointing away from the speaker to avoid feedback.

FIG. 1 illustrates cellular telephone 10 having display 12 and keypad 13 in a folding case that closes about hinge 15.

Microphone 17 is located at one end of cellular telephone 10 and speaker 18 is located at the opposite end of cellular telephone 10, much like the handsets of earlier telephones. Second microphone 19 is located on the outside of the case, pointing away from speaker 18, forming an array of two microphones with microphone 18.

Microphone 17 is a near-field microphone and microphone 19 is a far-field microphone. Microphone 17 and speaker 18 are lie on axis 21 of cellular telephone 10. FIG. 2 is a profile of a person's head. Axis 22 intersects the ear canal and the mouth. Axes 21 and 22 are parallel to each other during a call, with speaker 18 (FIG. 1) located near the ear canal. With the axes thus aligned, the inter-microphone level difference is large. Unfortunately, cellular telephones are not always positioned in this manner. The near-field microphone is often shifted off axis by 60° or more. When this happens, the microphones in the array are approximately equidistant from the mouth of the user. Sound from the user is incident upon both microphones at approximately the same time and approximately the same amplitude. The near-field microphone may also be moved out of the plane of the figure, further increasing the distance to the mouth of a user.

Using plural microphones, it is possible to estimate the direction of arrival of any sound incident on the array. If the direction of arrival range of a desired sound is known, then the direction of arrival estimate is a powerful statistic that can be used to detect the presence of this desired signal. Speech enhancement or noise reduction algorithms can aggressively remove interfering signals that are not arriving within the acceptance angle of the array.

If the acceptance angle of the array is wide, then the control derived using the direction of arrival estimate may not enhance a speech enhancement or noise reduction algorithm. In a situation like this, it is desirable to use statistics other than direction of arrival estimate to get better performance.

If the source of the interfering sounds and the source of the desired speech are spatially separated, then one can theoretically extract a clean speech signal from interfering sounds. A spatial separation algorithm needs more than one microphone to obtain the information that is necessary to extract the clean speech signal. Many spatial domain algorithms have been widely used in other applications, such as radio frequency (RF) antennas. The algorithms designed for other applications can be used for speech but not directly. For example, algorithms designed for RF antennas assume that the desired signal is narrow band whereas speech is relatively broad band, 0-8 kHz.

Inter-Microphone Level Difference (IMD)

The power of acoustic waves propagating in a free field outward from a source will decrease as a function of distance, r, from the center of source. Specifically, the power is inversely proportional to square of the distance. It is known from acoustical physics that the effect of $r^2$ loss becomes insignificant in a reverberant field.

If a dual microphone array is in the vicinity of the source of desired signal, then the $r^2$ loss phenomenon can be exploited by comparing signal levels between far and near microphones. The inter-microphone level difference can distinguish a near-field desired signal from a far-field directional signal or a diffuse-field interfering signal, if the near-field signal is sufficiently louder than the others; e.g. see U.S. Pat. No. 7,512,245 (Rasmussen et al.).

As the distance increases from an acoustic source to a microphone, the reverberant sounds are comparable in magnitude to the direct path sounds. Measured propagation loss will not truly represent the direct path inverse square law loss. Similarly, inter-microphone level difference increases with increasing spacing of the microphones, which means that the statistic is often insufficient for compact cellular telephones.

It has been found that the inter-microphone level difference does not clearly detect the presence of near-field sounds in the presence of a far-field directional sound or when the axis is offset by more 45°. Thus, inter-microphone level difference alone is not a good statistic to decide whether or not the sounds incident on the microphone array include a near-field sound.

In view of the foregoing, it is therefore an object of the invention to provide a reliable indication of near-field sounds to improve speech enhancement or noise reduction.

Another object of the invention is to improve the reliability of inter-microphone level difference as an indicator of near-field sounds.

A further object of the invention is to provide statistics for reliably detecting near-field sounds in the presence of either a far-field directional sound or a diffuse-field sound.

Another object of the invention is to provide a process and apparatus for exaggerating far-field directional signals or diffuse-field signals to improve near-field detection.

A further object of the invention is to provide a process and apparatus for detecting a near-field sound when the near-field sound is corrupted by either a far-field directional sound or a diffuse-field sound.

Another object of the invention is to provide improved near-field detection when a microphone array is positioned off-axis.

SUMMARY OF THE INVENTION

The foregoing objects are achieved in this invention in which a telephone includes at least two microphones and a circuit for processing audio signals coupled to the microphones. The circuit processes the signals, in part, by providing at least one statistic representing maximum normalized cross-correlation of the signals from the microphones, doaEst, dirGain, or diffGain and comparing the at least one statistic with a threshold for that statistic. At least one of noise reduction and speech enhancement is controlled by an indication of near-field sounds in accordance with the comparison. Indication of near-field speech can be further enhanced by combining statistics, including a statistic representing inter-microphone level difference, each of which have their own threshold. dirGain and diffGain are derived from signals incident upon the microphones such that the desired near-field signal is not suppressed,

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
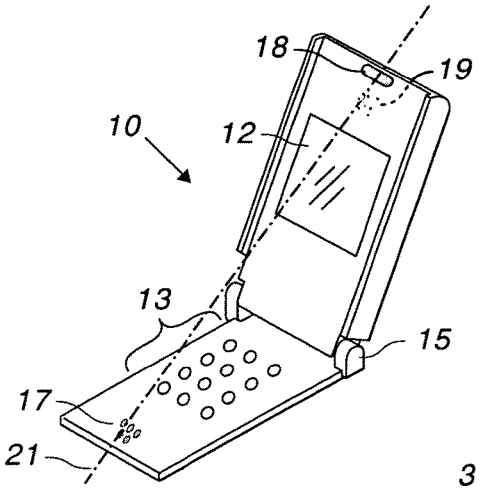
FIG. 1 is a perspective view of a cellular telephone.
Figure 3:
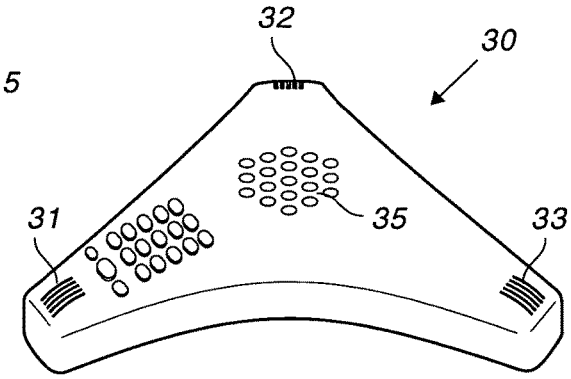
FIG. 3 is a perspective view of a conference phone or a speaker phone.
Figure 2:
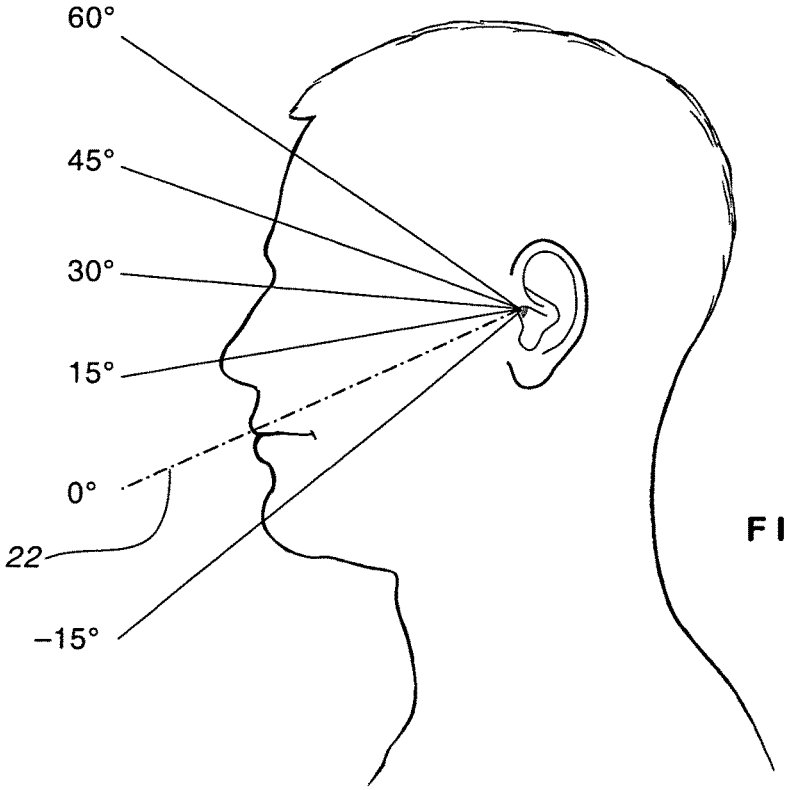
FIG. 2 illustrates several alignments of a cellular telephone relative to a person's head.

For the sake of simplicity, the invention is described in the context of a cellular telephone but has broader utility; e.g. communication devices that do not utilize a dial tone, such as radio frequency transceivers or intercoms. This invention finds use in many applications where the internal electronics are essentially the same but the external appearance of the device is different. FIG. 3 illustrates a conference phone or speaker phone such as found in business offices. Telephone 30 includes microphones 31, 32, 33, and speaker 35 in a sculptured case. Which microphone is the near-field microphone depends upon which of microphones 31, 32, or 33 is closest to the person speaking. Even so, the invention can be used to improve speech enhancement or noise reduction under these circumstances.

Maximum Normalized Cross-Correlation (MNC)

When an acoustic source is close to a microphone, the direct to reverberant signal ratio at the microphone is usually high. The direct to reverberant ratio usually depends on the reverberation time of the room or enclosure and other structures that are in the path between the near-field source and the microphone. When the distance between the source and the microphone increases, the direct to reverberant ratio decreases due to propagation loss in the direct path, and the energy of reverberant signal is comparable to the direct path signal. In accordance with one aspect of the invention, this effect is used to generate a statistic that reliably indicates the presence of a near-field signal regardless of the position of the array.

When a sound source is close to the microphone array, the normalized cross-correlation of the signals from the two microphones is dominated by the direct path signal. The normalized cross-correlation has a peak at a time corresponding to the propagation delay between the two microphones. Other peaks correspond to reflected signals. For far-field directional and diffuse-field signals, the peaks of the cross-correlation is smaller than the peak for near-field signals due to the $r^2$ loss phenomenon.

Figure 4:
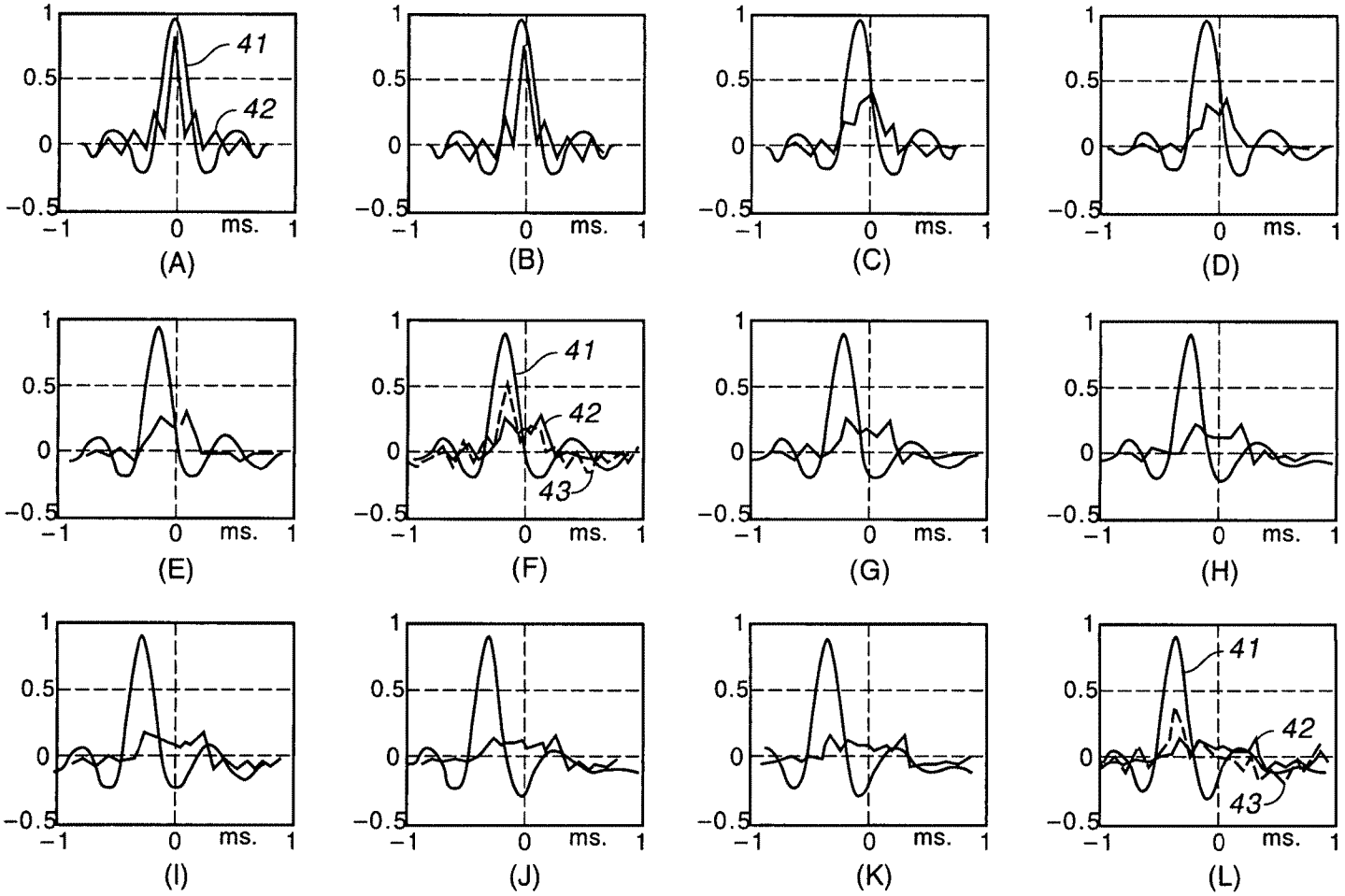
FIG. 4 is a group of charts illustrating normalized cross-correlation.

FIG. 4 is a group of charts illustrating the normalized cross-correlation of near-field signals 41 and diffused-field signals 42 at various microphone spacings and distances from the mouth, as indicated by the following table.

TABLE 1

| FIG. | microphone spacing (cm) | distance of near microphone from mouth (cm) |
|---|---|---|
| 4(A) | 1 | 13 |
| 4(B) | 2 | 12 |
| 4(C) | 3 | 11 |
| 4(D) | 4 | 10 |
| 4(E) | 5 | 9 |
| 4(F) | 6 | 8 |
| 4(G) | 7 | 7 |
| 4(H) | 8 | 6 |
| 4(I) | 9 | 5 |
| 4(J) | 10 | 4 |
| 4(K) | 11 | 3 |
| 4(L) | 12 | 2 |

FIG. 4 (F) and FIG. 4 (L) also indicate the normalized cross-correlation of far-field directional signals (dashed line 43) at the specified distances. In FIG. 4 (A), the normalized cross-correlation of diffuse-field signals is indistinguishable from curve 41 unless chart (A) is made considerably larger. Note how the normalized cross-correlation of near-field signals dominates in FIG. 4 (L).

The peak of the cross-correlation moves as a function of microphone spacings. Even though the cross-correlation for a far-field directional signal has a peak corresponding to the direction of arrival, the peak value is comparable to the ones corresponding to reflected signals. For a diffuse-field, the cross-correlation is much flatter than other two sound fields because there is no distinct directional component in a diffuse-field. Thus, the maximum value of the normalized cross-correlation can be used to differentiate near-field signals from far-field or diffuse-field signals.

Tests have shown that the cross-correlation value for near-field is above 0.9 (maximum is 1.0) for microphone spacings of 1-12 cm. The cross-correlation for the far-field directional and diffuse-field is below 0.6 when the microphone spacing is greater than 2 cm. For smaller microphone spacings, the cross-correlation value for far-field directional signals and for diffuse signals is high because the microphones are so closely spaced that even the reverberant signals are closely correlated between the near and far microphones due to very close spatial sampling. The cross-correlation statistic is independent of off-axis angle.

Thus, correlation statistic is a good statistic to differentiate between near-field and far-field or diffuse-field signals. The statistic is also robust to any changes in array position. The statistic is above 0.7 when the near-field to far-field directional signal ratio is greater than about 20 dB. As the near-field to far-field directional signal ratio decreases, the peak value of the cross-correlation also decreases. Thus, a near-field detector using correlation statistic is not robust when a significant amount of diffuse signal is also present.

The inter-microphone level difference fails to unambiguously detect near-field signals at several off-axis angles or in the presence of diffuse-field signals. The cross-correlation statistic is independent of off-axis angle but is weak in a significant diffuse-field. Otherwise, the cross-correlation statistic is relatively robust by itself. In accordance with the invention, these statistics are combined as follows. (1) If the inter-microphone level difference is very high or if the maximum normalized cross-correlation value is very high, then a near-field signal is necessarily present. (2) If both the inter-microphone level difference and the maximum normalized cross-correlation statistics are above a certain threshold, then there is a high probability of near-field signal presence. For example, at a 10 cm microphone spacing, if the level difference threshold is set at 3 dB and the cross-correlation threshold is set at 0.45, then the probability of near-field detection is high up to 15 dB near-field to far-field directional signal ratio and 45° off-axis angle.

Figure 5:
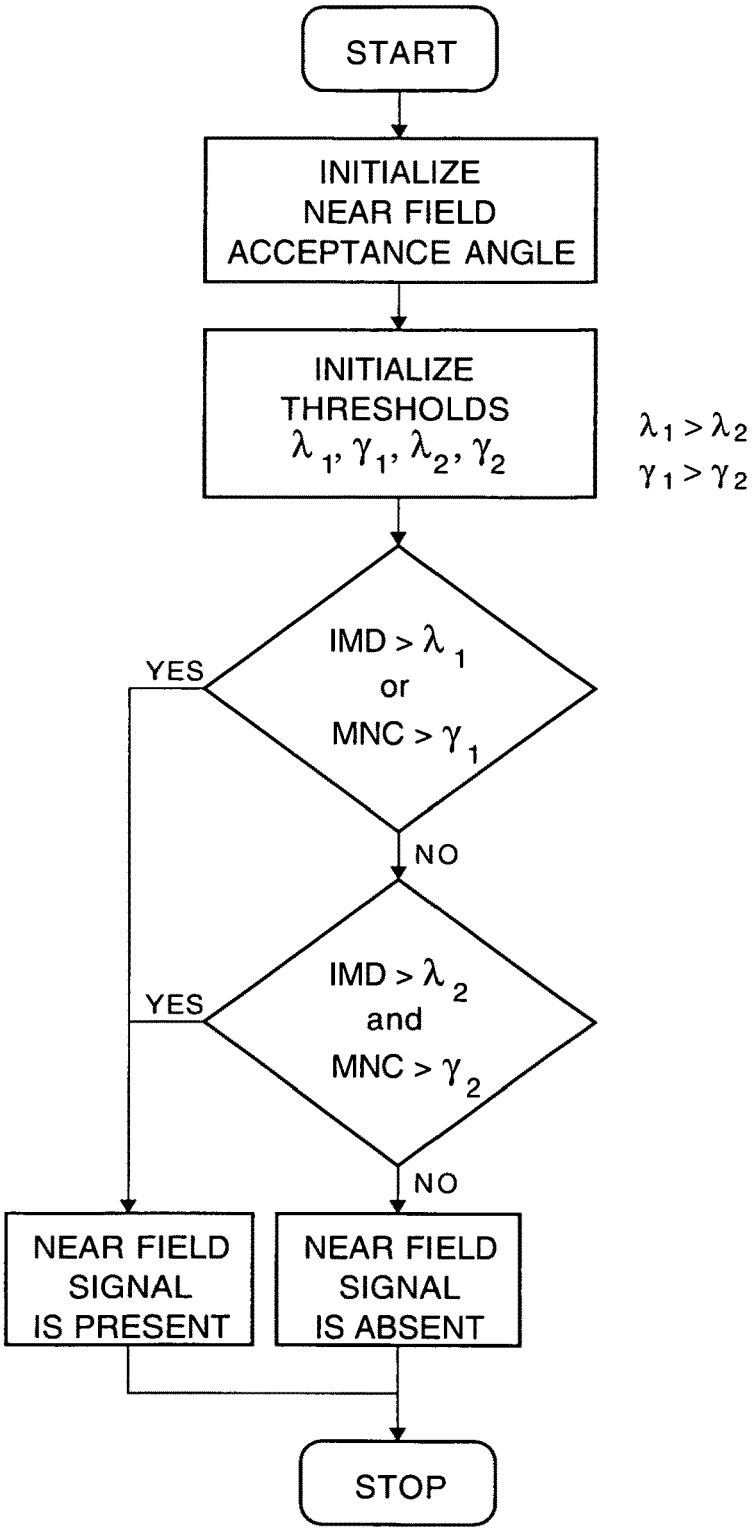
FIG. 5 is a flow chart of a method for detecting near-field speech based on inter-microphone level difference and maximum normalized cross-correlation.

There are different degrees of confidence in the decisions arrived at by the above two logical conditions. The first condition results in a more definitive decision albeit with lower probability of detection in low near-field to far-field directional signal ratios. The second condition involves more randomness because of the difficulty in setting the thresholds that will satisfy all test conditions. However, one can still use both decisions to control different parameters of a speech enhancement or noise reduction algorithms in real world applications. FIG. 5 is a flow chart of a process combining inter-microphone level difference and maximum normalized cross-correlation to determine whether or not a sound is near field.

Direction of Arrival

In accordance with another aspect of the invention, if the direction of arrival of the near-field signal is known, then the confidence level can be improved in a decision arrived at by the above two logical conditions.

The direction of arrival estimate provides the actual angular location estimate of the respective sources with respect to a microphone array. One can detect the presence of a near-field signal by knowing the acceptance angle of its arrival. If the far-field directional signal also originates within the same acceptance angle, then the direction of arrival statistic alone cannot distinguish between the near field and far field.

In a diffuse-field, the incoming sounds are arriving from different directions. Therefore, the variance of the direction of arrival estimate is high in a diffuse-field. Even though the maximum cross-correlation value drops as the diffuse signal level increases, the peak is distinct. This peak corresponds to the direct path propagation delay between the near and far microphones. In accordance with another aspect of the invention, the direction of arrival estimate is obtained using the lag corresponding to the maximum cross-correlation value. Thus the direction of arrival estimate is robust to presence of a diffuse-field signal.

The direction of arrival statistic can also be used to track changes in array position itself. The direction of arrival estimation error increases as near-field to far-field directional signal ratio decreases. If the distance between the near microphone and the mouth is not large (less than 12 cm), then the estimation error is still acceptable for making a fairly accurate decision between the diffuse-field and near-field signals. The direction of arrival estimate is able to track changes in different array positions under various near-field to far-field directional signal ratio conditions provided that the near-field to far-field directional signal ratio is not too small, e.g. greater than 3 dB, and spacing of the microphones is not too small, e.g. greater than 2 cm.

Figure 6:
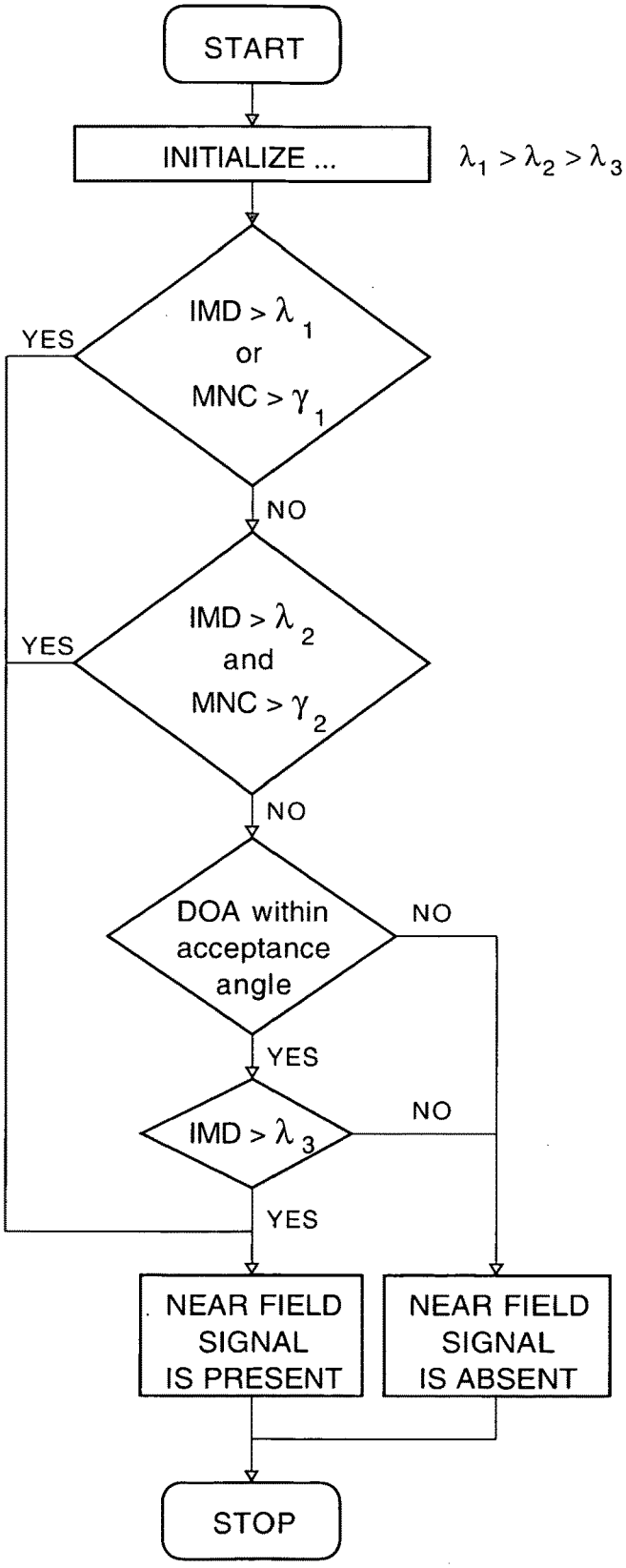
FIG. 6 is a flow chart of a method for detecting near-field speech based on inter-microphone level difference, maximum normalized cross-correlation, and direction of arrival.

None of the three statistics described thus far can be used as the only statistic to detect near-field sounds under all conditions likely to be encountered by a cellular telephone. In accordance with the invention, statistics are combined to provide a better detector. For example, if the direction of arrival estimate is consistently within the acceptance angle, then the sound that is incident on the array is either a near-field sound or a far-field directional sound. The inter-microphone level difference differentiates between near-field sounds and far-field directional sounds. FIG. 6 is a flow chart of a detector that combines statistics to make a decision.

Signal Reduction

Near detector performance degrades when diffuse sound or far-field directional sound is present with near-field sound. In accordance with another aspect of the invention, the acceptance angle of the near-field sound is used to reduce the diffuse signal or the far-field directional signal. This process does not suppress or distort any signals that are arriving within the acceptance angle of the array of microphones and provides statistics for detecting near sounds.

Figure 7:
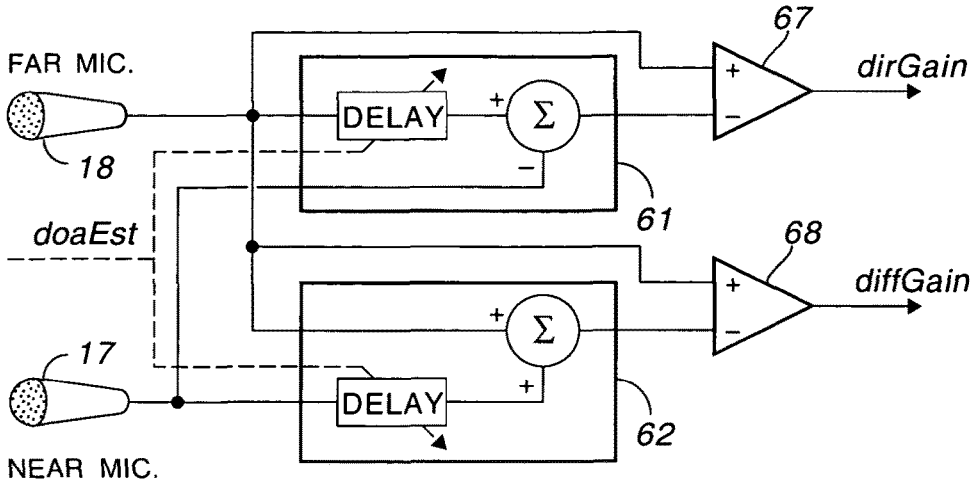
FIG. 7 is a block diagram of a circuit for detecting near-field speech by manipulating gain based on direction of arrival.

FIG. 7 is a block diagram of apparatus for computing the amount of reduction for directional far-field directional signals or for diffuse-field signals. The signals from microphones 17 and 18 are combined as indicated in signal reduction blocks 61 and 62. The direction of arrival estimate, doaEst, for the incoming sounds controls the amount of delay. Optimum delay is determined by microphone spacing and doaEst. If the incoming sound is within the acceptance angle, doaEst is used to compute the delay for diffused gain. Otherwise, doaEst is used to compute the delay for directional gain.

Knowing the direction of arrival of the incoming signal, canceling most of the signal coming from the direction of the interfering sound reduces directional far-field noise. In this case, the gain for a signal within the acceptance angle is maintained at approximately 0 dB. For reducing diffused noise, because the diffused sound is arriving from no particular direction, or many directions, the signals are simply delayed and summed, block 62, while maintaining approximately 0 dB gain for sounds within the acceptance angle.

The difference in amplitude between the output and the input of signal reduction block 61 is calculated in subtraction circuit 67, providing an estimate of far-field directional signal reduction, dirGain. The difference in amplitude between the output and the input of signal reduction block 62 is calculated in subtraction circuit 68, providing an estimate of the diffuse-field signal reduction, diffGain.

The delay for block 62 is calculated when doaEst is within the acceptance angle. The means that the desired near-field sound arrives at near microphone 17 earlier than at far microphone 18. Therefore, the near-field signal from microphone 17 has to be delayed.

The difference between output and input in blocks 61 and 62 changes with the presence or absence of a near-field signal. Specifically, the difference is small when a near-field signal is present, even with a far-field directional signal or a diffuse-field signal, and it is large when a far-field directional signal or a diffuse-field signal alone is present. In accordance with the invention, this difference is used to distinguish between a diffuse signal and a far-field directional signal.

Figure 8:
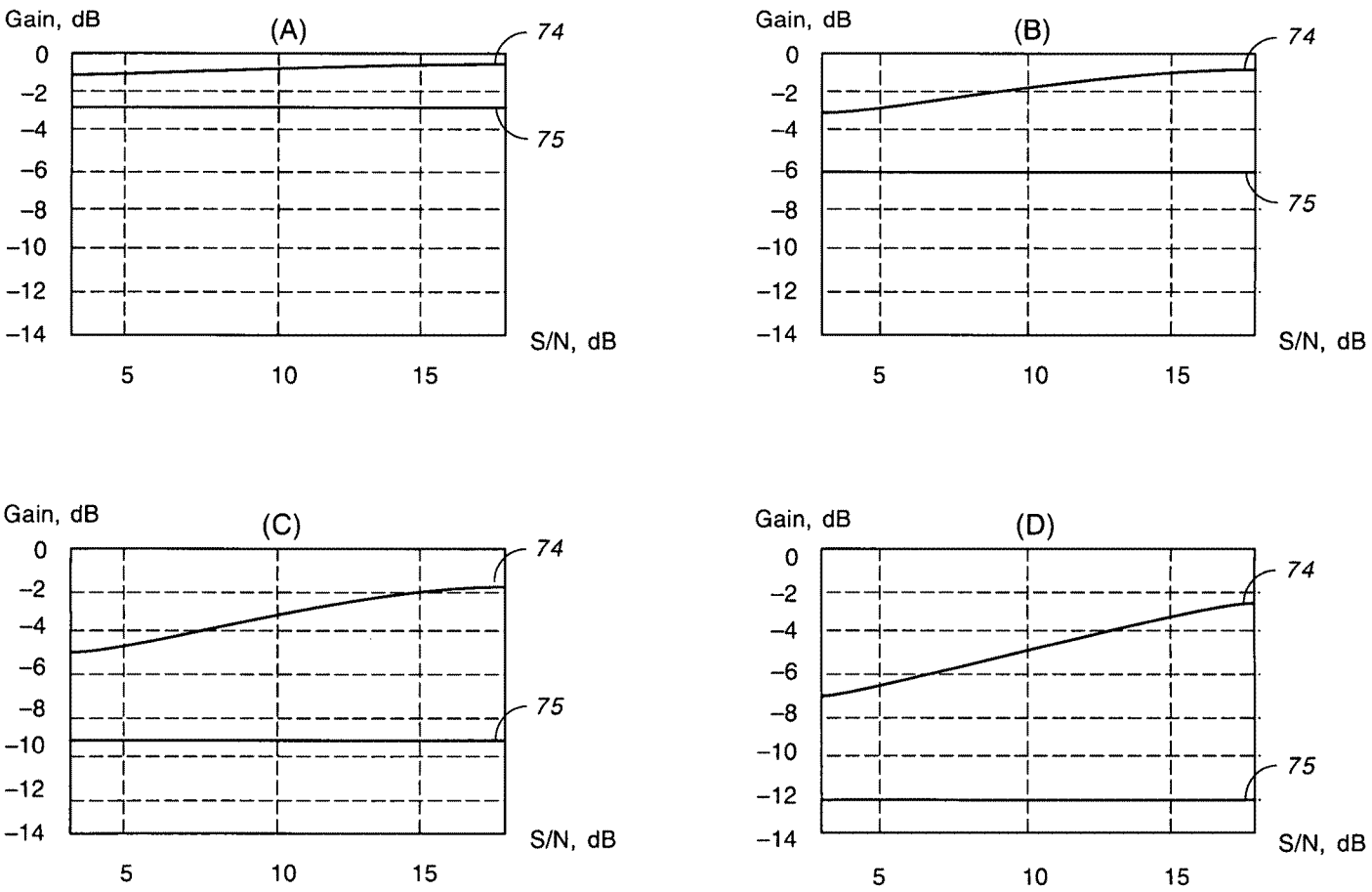
FIG. 8 is a group of charts illustrating gain reduction in accordance with one aspect of the invention.

FIG. 8 is a group of charts illustrating far-field signal (either directional or diffuse) suppression at signal to noise ratios (S/N) of (A) 3 dB, (B) 6 dB, (C) 9 dB, and (D) 12 dB. Trace 75 represents gain when an interfering signal alone is present. Trace 74 represents gain when a near-field signal is also present. For example, in FIG. 8 (C), when the gain in signal reduction in block 62 is −9 dB with no near-field signal and the gain is −5 dB when a near-field signal is also present. Thus, there is a 4 dB change in gain depending on whether or not a near-field signal is present. Similarly, in block 61, signal reduction is greater when only a far-field directional signal is present than when a near-field signal is also present. It is the presence of a desired signal that makes the difference in gain. The gains of blocks 61 and 62 when a near-field signal is present need not be identical.

Combining Statistics

Figure 9:
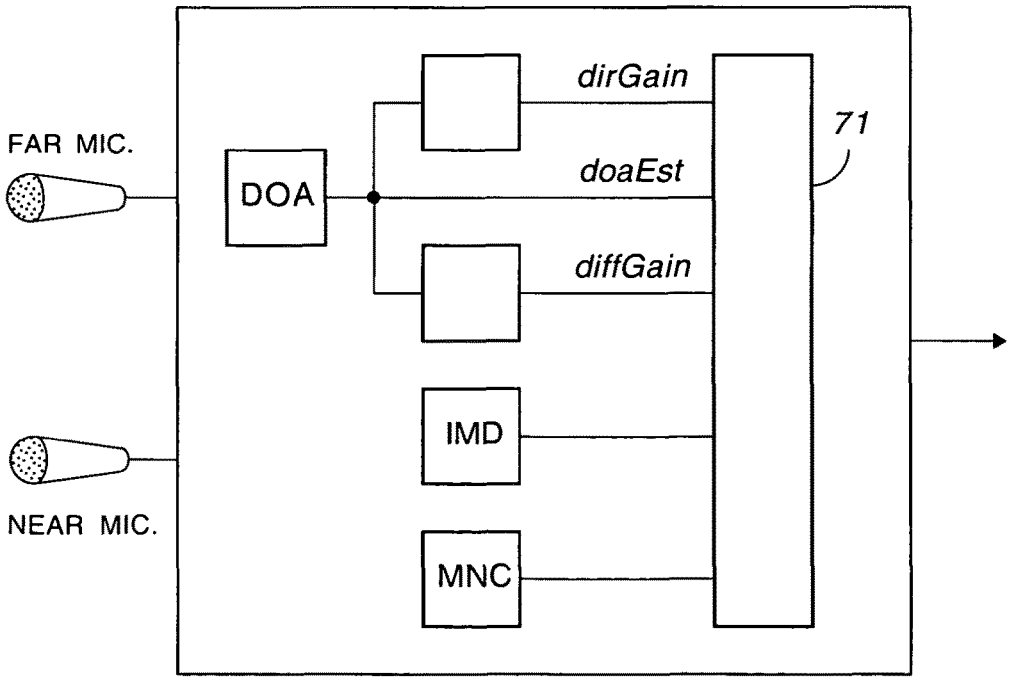
FIG. 9 is a block diagram of a circuit for detecting near-field speech based upon inter-microphone level difference, maximum normalized cross-correlation, direction of arrival, far-field gain, and diffuse-field gain.

In accordance with the invention, five different spatial statistics can be combined in various combinations to detect near-field signals. Combining the statistics provides a reliable indication of a near-field signal. FIG. 9 is a block diagram of a robust near-field detector that combines the all five statistics.

Figure 10:
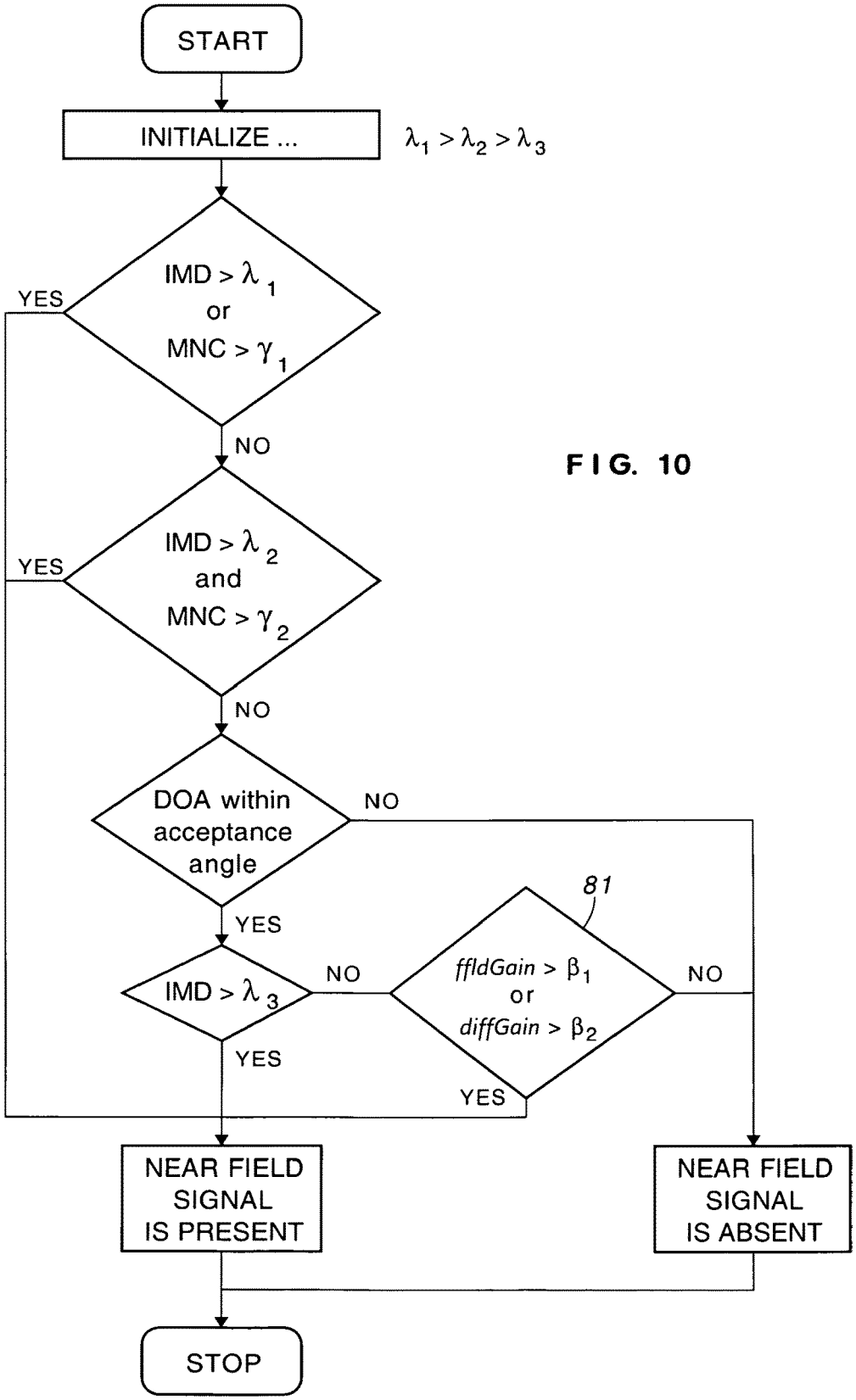
FIG. 10 is a flow chart illustrating the operation of a logic circuit in FIG. 9.

FIG. 10 is a flow chart illustrating the operation of logic 71 (FIG. 9). If the system gain after directional or diffuse-field signal suppression is high, then it is very likely that the near-field signal is present. Test 81 improves the probability of detecting a near-field signal when the near-field signal is corrupted by either a far-field directional signal or a diffuse-field signal.

Figure 11:
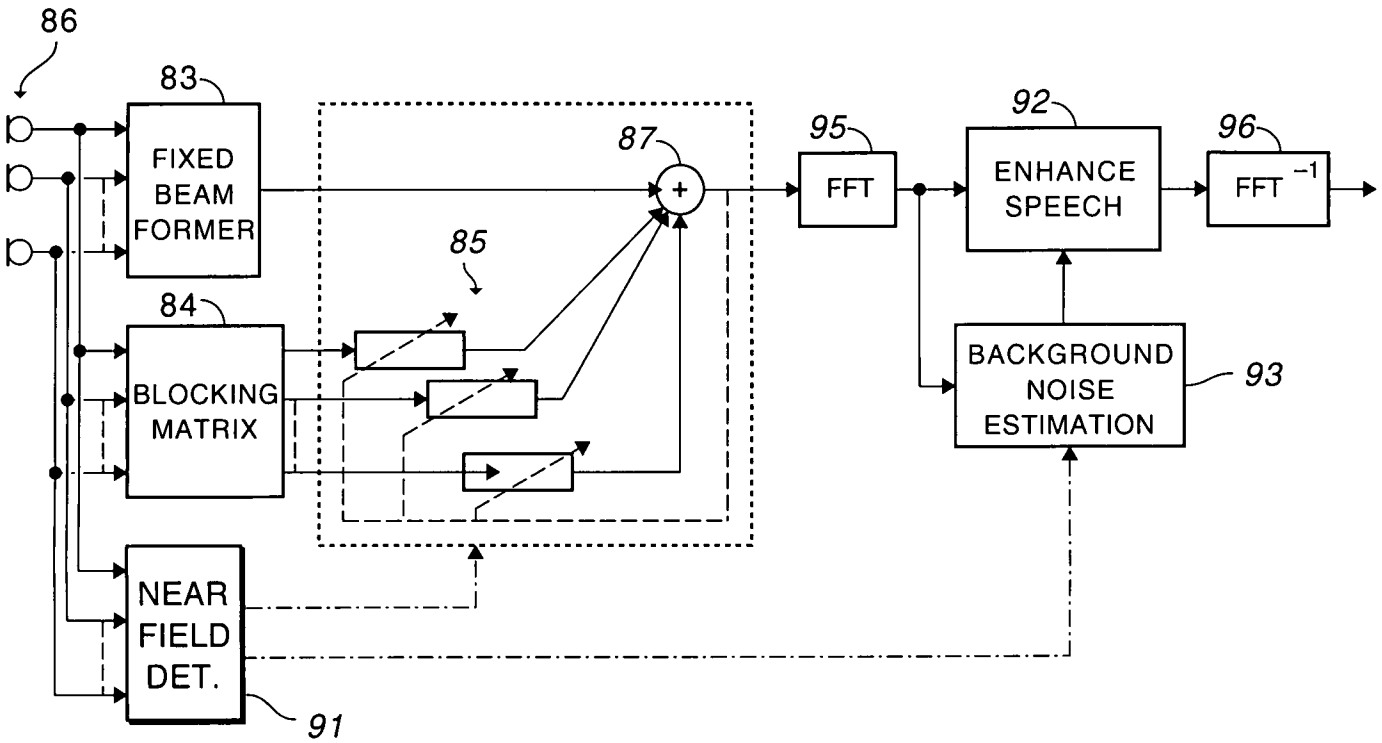
FIG. 11 is a block diagram of a speech enhancement circuit controlled by a near field detector constructed in accordance with the invention.

In FIG. 11, fixed beam former 83, blocking matrix 84, and adaptive filters 85 provide what is known in the art as generalized side lobe cancellation. "Side lobe" refers to the reception pattern of a microphone array, which has a main lobe, centered on the nominal acceptance angle, and side lobes. The reception pattern depends on the kind of microphones, spacing of the microphones, orientation of the microphones relative to each other, and other factors.

Fixed beam former 83 defines the acceptance angle. The performance of fixed beam former 83 alone is not sufficient because of side lobes in the beam. The side lobes need to be reduced. Blocking matrix 84 forms a null beam centered in the acceptance angle of microphone array 86. If there is no reverberation, the output of blocking matrix 84 should not contain any signals that are coming from the preferred direction.

Blocking matrix 84 can take many forms. For example, with two microphones, the signal from one microphone is delayed an appropriate amount to align the outputs in time. The outputs are subtracted to remove all the signals that are within the acceptance angle, forming a null. This is also known as a delay and subtract beam former. If the number of microphones is more than two, then adjacent microphones are aligned in time and subtracted. In ideal conditions, all the outputs from blocking matrix 84 should contain signals arriving from directions other than the preferred direction. The outputs from blocking matrix 84 serve as inputs to adaptive filters 85 for canceling the signals that leaked through the side lobes of the fixed beam former. The outputs from adaptive filters 85 are subtracted from the output from fixed beam former 83 in subtraction circuit 87.

The output signals from blocking matrix 84 will often contain some desired speech due to mismatches in the phase relationships of the microphones and the gains of the amplifiers (not shown) coupled to the microphones. Reverberation also causes problems. If the adaptive filters are adapting at all times, then they will train to speech from the blocking matrix, causing distortion at the subtraction stage.

Near-field detector 91 is constructed in accordance with the invention and controls the operation of adaptive filters 85. Specifically, the filters are prevented from adapting when a near-field signal is detected. Near-field detector 91 also controls speech enhancement circuit 92. A background noise estimate from circuit 93 is subtracted from the signal from subtraction circuit 87 to reduce noise in the absence of a near-field signal. Circuits 92 and 93 operate in frequency domain, as indicated by fast Fourier transform circuit 95 and inverse fast Fourier transform circuit 96.

The invention thus provides a reliable indication of near-field sounds to improve speech enhancement or noise reduction by detecting a near-field sound when the near-field sound is corrupted by either a far-field directional sound or a diffuse-field sound or when a microphone is positioned off-axis. A process in accordance with the invention provides statistics for reliably detecting near-field sounds in the presence of either a far-field directional sound or a diffuse-field sound and provides some statistics by exaggerating far-field directional signals or diffuse-field signals to improve near-field detection. The invention also improves the reliability of inter-microphone level difference as an indicator of near-field sounds.

Having thus described the invention, it is apparent to those of skill in the art that various modifications can be made within the scope of the invention. Specific numerical examples are for example only, depending upon the hardware chosen, such as the type, number, and placement of microphones. Other techniques can be used to implement signal reduction blocks 61 and 62 (FIG. 7). Any circuit can be used that reduces either the far-field directional signal or the diffuse-field signal without substantially attenuating the signal coming from the desired direction.

What is claimed as the invention is:

1. A process for detecting near-field sounds with at least first and second microphones that receive first and second audio signals, respectively, wherein the first of the microphones is a near-field microphone, said process comprising the steps of:

providing a first statistic representing a direction of arrival estimate;

providing a second statistic representing far field directional gain, wherein the second statistic is provided by the steps of:

subtracting the second audio signal from the first audio signal to produce a first difference signal;

subtracting the first difference signal from the second audio signal to produce a second difference signal;

deriving the far field directional gain from the second difference signal;

providing a third statistic representing diffuse field gain;

comparing each statistic with a threshold value for each statistic; and providing an indication of near-field sounds in accordance with the comparisons.

2. The process of claim 1 including the step of generating a delayed audio signal corresponding to a time-delayed version of one of the first and second audio signals.

3. The process of claim 2 wherein the step of generating the delayed audio signal includes the step of deriving the delayed audio signal from the direction of arrival estimate.

4. The process of claim 3 including the further step of:

providing a maximum normalized cross-correlation of the first and second audio signals, and wherein the step of deriving the delayed audio signal from the direction of arrival estimate includes the step of converting the direction of arrival estimate into the delayed audio signal only when the maximum normalized cross-correlation is below a maximum normalized cross-correlation threshold.

5. A process for detecting near-field sounds with at least first and second microphones that receive first and second audio signals, respectively, wherein the first of the microphones is a near-field microphone, said process comprising the steps of:

providing a first statistic representing a direction of arrival estimate;

providing a second statistic representing far field directional gain;

providing a third statistic representing diffuse field gain, wherein the third statistic is provided by the steps of:

adding the first audio signal to the second audio signal to produce a summed signal;

subtracting the summed signal from the second audio signal to produce a difference signal; and deriving the diffuse field gain from the difference signal;

comparing each statistic with a threshold value for each statistic; and providing an indication of near-field sounds in accordance with the comparisons.

6. The process of claim 5 including the step of generating a delayed audio signal corresponding to a time-delayed version of one of the first and second audio signals.

7. The process of claim 6 wherein the step of generating the delayed audio signal includes the step of deriving the delayed audio signal from the first statistic representing the direction of arrival estimate.

8. The process of claim 7 including the further steps of:

a) providing a maximum normalized cross-correlation of the first and second audio signals, and b) comparing the maximum normalized cross-correlation with a maximum normalized cross-correlation threshold;

wherein the delayed audio signal is derived from the first statistic representing the direction of arrival estimate only when the maximum normalized cross-correlation of the first and second audio signals is above the maximum normalized cross-correlation threshold.

9. A telephone comprising in combination:

a) a first microphone for receiving a first audio signal, the first microphone being a near-field microphone, b) a second microphone for receiving a second audio signal, c) an audio signal processor circuit for processing the first and second audio signals, the audio signal processor circuit being coupled to said first and second microphones, said audio signal processor circuit processing said first and second audio signals, in part, by:

i) providing a maximum normalized cross-correlation of the first and second audio signals, ii) comparing the maximum normalized cross-correlation with a maximum normalized cross-correlation threshold; and iii) providing an indication of the presence of near-field sounds in accordance with the said comparison, d) the audio signal processor circuit also provides a far field directional gain signal by:

subtracting the first audio signal from the second audio signal to create a first difference signal;

subtracting the first difference signal from the second audio signal to produce a second difference signal; and providing the second difference signal as the far field directional gain signal e) the audio signal processor circuit compares the far field directional gain signal with a far field directional gain threshold;

f) the audio signal processor circuit being responsive to the indication of the presence of near-field sounds for controlling operation of at least one of noise reduction and speech enhancement; and g) the audio signal processor circuit providing at least one of noise reduction and speech enhancement.

10. A telephone comprising in combination:

a) a first microphone for receiving a first audio signal, the first microphone being a near-field microphone, b) a second microphone for receiving a second audio signal, c) an audio signal processor circuit for processing the first and second audio signals, the audio signal processor circuit being coupled to said first and second microphones, said audio signal processor circuit processing said first and second audio signals, in part, by:

i) providing a maximum normalized cross-correlation of the first and second audio signals, ii) comparing the maximum normalized cross-correlation with a maximum normalized cross-correlation threshold; and iii) providing an indication of the presence of near-field sounds in accordance with said comparison, d) the audio signal processor circuit also providing at least one of noise reduction and speech enhancement, and e) the audio signal processor circuit being responsive to the indication of the presence of near-field sounds for controlling operation of at least one of noise reduction and speech enhancement;

f) the audio signal processor circuit also provides a diffuse field gain signal by:

adding the first audio signal to the second audio signal to create a summed signal;

subtracting the summed signal from the second audio signal to create a difference signal; and providing the difference signal as the diffuse field gain signal; and g) the audio signal processor circuit compares the diffuse field gain signal with a diffuse field gain threshold.

* * * * *